US006651445B1

(12) United States Patent
Clark et al.

(10) Patent No.: US 6,651,445 B1
(45) Date of Patent: Nov. 25, 2003

(54) FOOD CHILLER WITH DUCTLESS AIR CIRCULATION

(75) Inventors: George A. Clark, Lewis Center, OH (US); Chris W. Cicenas, Columbus, OH (US); Joshua A. Broehl, Worthington, OH (US)

(73) Assignee: Delta T, LLC, Racine, WI (US)

( * ) Notice: Subject to any disclaimer, the term of this patent is extended or adjusted under 35 U.S.C. 154(b) by 0 days.

(21) Appl. No.: 10/192,112

(22) Filed: Jul. 10, 2002

(51) Int. Cl.[7] ..... F25B 21/02
(52) U.S. Cl. ..... 62/3.6; 62/3.62; 62/457.6
(58) Field of Search ..... 62/3.2, 3.6, 3.62, 62/457.6

(56) References Cited

U.S. PATENT DOCUMENTS

| | | | | |
|---|---|---|---|---|
| 2,446,686 A | | 8/1948 | Behrens | |
| 2,915,884 A | | 12/1959 | Haushalter et al. | |
| 3,040,539 A | | 6/1962 | Gaugler | |
| 3,823,567 A | | 7/1974 | Corini | |
| 3,986,337 A | | 10/1976 | Richard | |
| 4,297,850 A | | 11/1981 | Reed | |
| 4,326,383 A | | 4/1982 | Reed et al. | |
| 4,472,945 A | | 9/1984 | Cech et al. | |
| 4,726,193 A | | 2/1988 | Burke et al. | |
| 4,823,554 A | | 4/1989 | Trachtenberg et al. | |
| 4,845,958 A | | 7/1989 | Senda et al. | |
| 5,042,258 A | | 8/1991 | Sundhar | |
| 5,111,664 A | | 5/1992 | Yang | |
| 5,209,069 A | | 5/1993 | Newnan | |
| 5,247,798 A | | 9/1993 | Collard, Jr. | |
| 5,315,830 A | | 5/1994 | Doke et al. | |
| 5,363,978 A | * | 11/1994 | Molo | 220/254.3 |
| 5,423,194 A | | 6/1995 | Senecal | |
| 5,431,021 A | | 7/1995 | Gwilliam et al. | |
| 5,456,164 A | | 10/1995 | Bang | |
| 5,598,713 A | | 2/1997 | Bartilucci | |
| 5,661,979 A | | 9/1997 | DeBoer | |
| 5,699,669 A | | 12/1997 | Gebhard | |
| 5,718,124 A | | 2/1998 | Senecal | |
| 5,762,228 A | * | 6/1998 | Morgan et al. | 220/367.1 |
| 5,771,709 A | | 6/1998 | Smith | |
| 5,782,094 A | | 7/1998 | Freeman | |
| 5,813,233 A | | 9/1998 | Okuda et al. | |
| 5,931,333 A | * | 8/1999 | Woodnorth et al. | 220/573.4 |
| 6,226,994 B1 | | 5/2001 | Yamada et al. | |
| 6,295,820 B1 | | 10/2001 | Cauchy et al. | |
| 6,308,519 B1 | | 10/2001 | Bielinski | |
| 6,351,951 B1 | | 3/2002 | Guo et al. | |
| 6,385,976 B1 | | 5/2002 | Yamamura et al. | |

OTHER PUBLICATIONS

US 6,381,965, 5/2002, Ghoshal (withdrawn)

* cited by examiner

*Primary Examiner*—William E. Tapolcai
(74) *Attorney, Agent, or Firm*—Andrus, Sceales, Starke & Sawall

(57) ABSTRACT

A food chiller includes a container into which cool air is moved over the cold sink of a Peltier effect thermoelectric device and directly into the container. Return air from the container exits the bottom of the container directly into the fan for recirculation. Elimination of a long air duct system simplifies the construction and reduces heat loss.

12 Claims, 12 Drawing Sheets

FOOD CHILLER WITH DUCTLESS AIR CIRCULATION

BACKGROUND OF THE INVENTION

The present invention relates to a device for chilling fresh fruit and other fresh food products and, more particularly, to an improved countertop fruit chiller utilizing a Peltier effect thermoelectric device.

Thermoelectric devices operating in accordance with the well know Peltier effect have been used as cooling/heating devices for many years. Such a thermoelectric device comprises an array of semiconductor couples connected electrically in series and thermally in parallel. The semiconductor couples are sandwiched between metalized ceramic substrates. When DC electric current is applied in series to the thermoelectric device, it acts as a heat pump with heat being absorbed on the cold side, thereby cooling it, while heat is dissipated at the other side. Reversing the current causes the direction of heat flow to be reversed. Attaching a heat sink and a cold sink to the respective hot and cold sides may enhance the efficiency of the thermoelectric device.

Peltier effect devices have long been used to provide coolers and/or heaters for keeping foods fresh or for warming foods for serving. It has also been found and is well known to use forced-air convection to aid in heat transfer. A small electric fan is typically used to circulate air past the cold sink and into and through a container for the food, while another fan moves ambient outside air across the heat sink to dissipate heat from it.

Although chillers for fresh fruit and other perishable food products are well known in the art, the market success of such devices has been limited. There appear to be a number of reasons for this lack of market success. One is the cost and heat transfer efficiency of the solid state thermoelectric modules. In addition, the need to provide circulation of cool air to attain the greatest cooling efficiency has led to complex duct systems which add substantially to the cost of the containers, typically made of molded plastic materials. Long and complex air circulation duct systems also result in heat loss and pressure drop, both of which decrease the efficiency or add to the product cost.

SUMMARY OF THE INVENTION

In accordance with the present invention, a chiller for fresh fruit or other perishable food products utilizes a construction, which minimizes manufacturing cost while still allowing optimized cooling airflow and permits the use of a relatively smaller thermoelectric module.

Thermoelectric modules of increased efficiency, such as disclosed in U.S. Pat. No. 5,448,109, are particularly suitable for use in the fruit chiller of the subject invention.

In its broadest aspect, the food chiller of the present invention comprises a base housing for mounting a Peltier effect thermoelectric module sandwiched between a cold sink and an opposite heat sink. A cool air circulation fan circulates air through the food container and over the cold sink. To reduce manufacturing cost there is no separate duct system. As the air exits the circulation fan it impinges the cold sink and directly enters the food container.

A food container portion is adjacent the base housing and contains an enclosing sidewall and a removable or openable cover for retrieval of the food.

In a preferred overall embodiment the housing containing the thermoelectric device is integrated with the food-containing portion thus minimizing the number of components to manufacture and therefore the manufacturing cost.

The food container portion is normally closed with a removable or openable cover such that cooling air is continuously recirculated. In one embodiment, however, an outside ambient air supply conduit communicates with the cooling duct system and includes a metering device to admit a controlled flow of outside air to assist in purging the cooling duct system of ethylene gas and other ripening by-products of fruit. The metering device may comprise a small diameter tube connected to the duct system upstream of the fan.

To help maintain the interior temperature of the container, a removable insulating sleeve may be inserted into the container. The sleeve is shaped to conform to the interior of the enclosing sidewall. The removable cover may also be provided with an insulating liner.

Various arrangements of partitions may be placed within the container to divide the container into different temperature zones by varying the flow of cooling air through the zones. Such partitions may be vertically disposed to extend upwardly from the container bottom wall or may be horizontally disposed and attached, for example, to a central tower or to the container sidewall.

DETAILED DESCRIPTION OF THE PREFERRED EMBODIMENT

Figure 1:
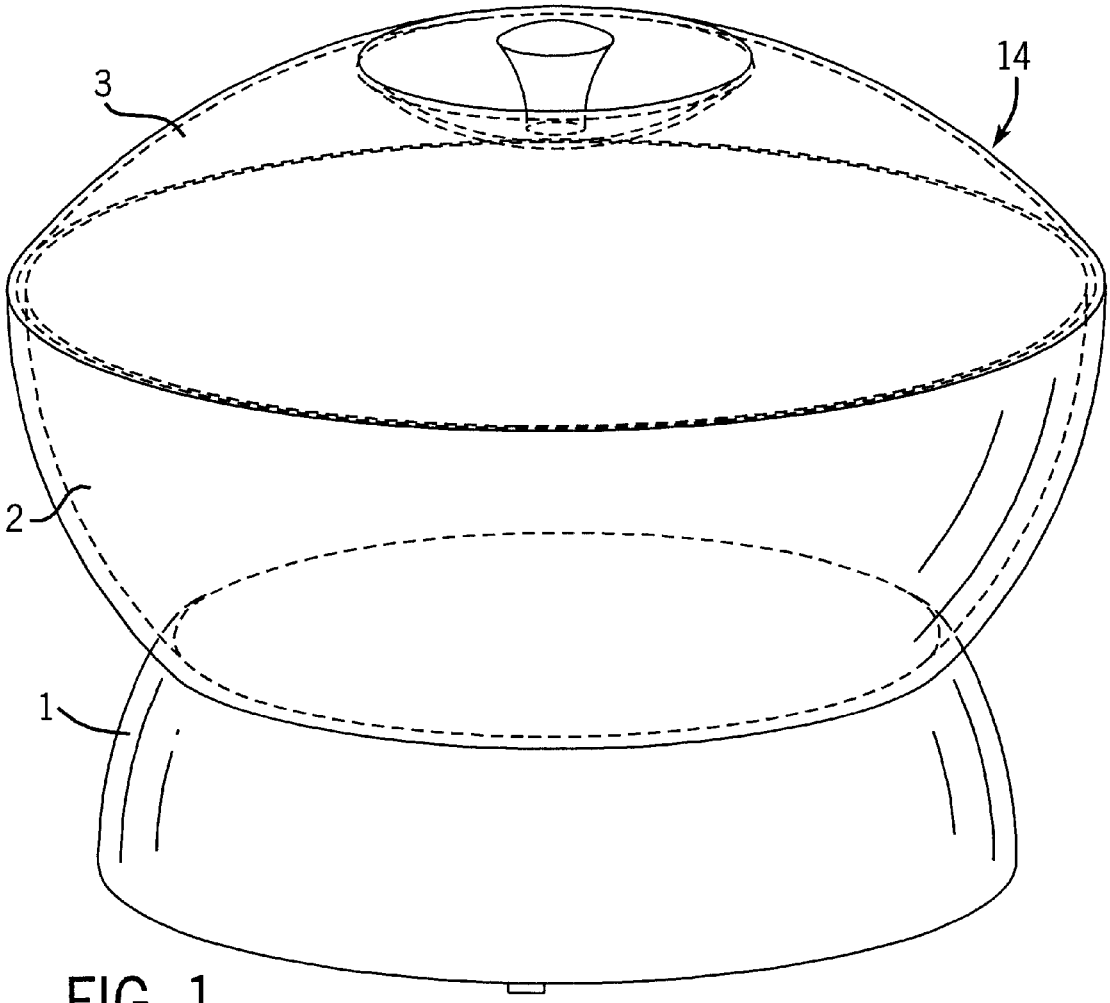
FIG. 1 is a perspective view showing the general arrangement of the fruit chiller of the subject invention.
Figure 2:
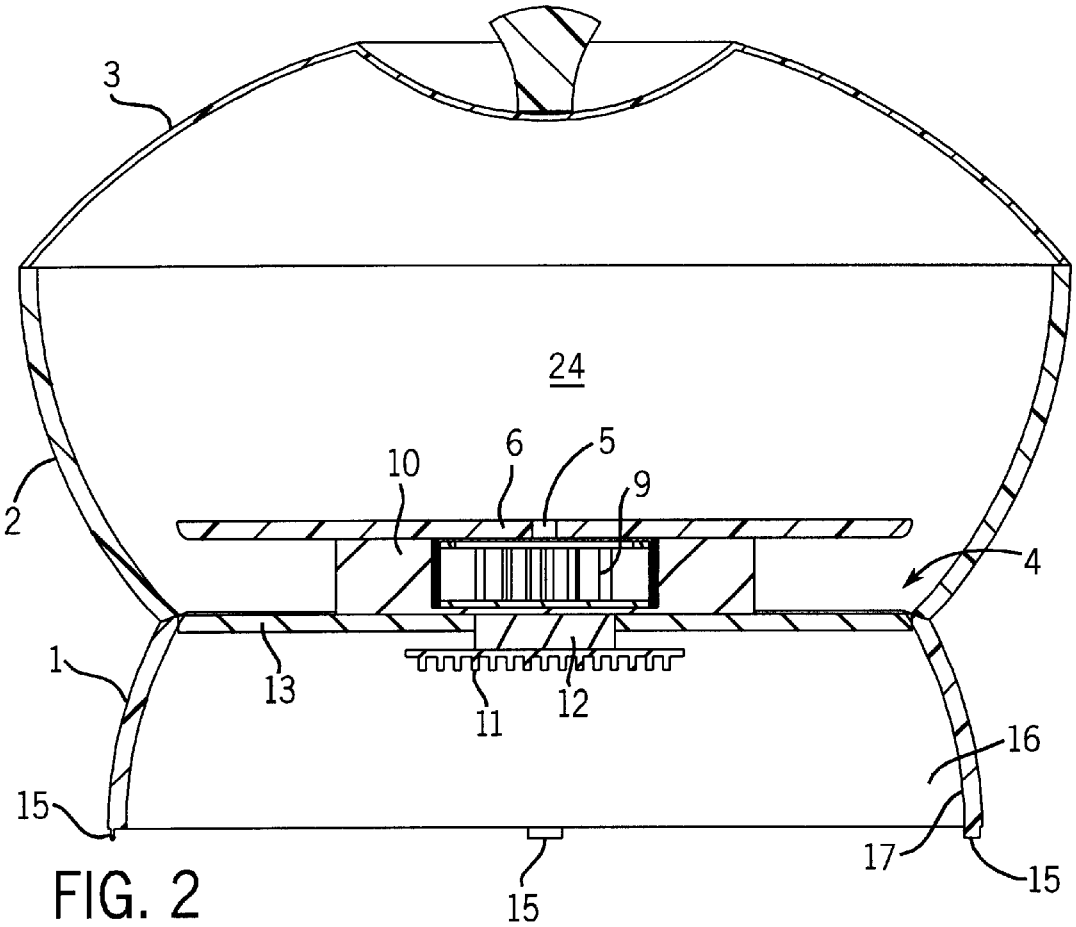
FIG. 2 is a vertical section through the fruit chiller shown in FIG. 1.
Figure 3:
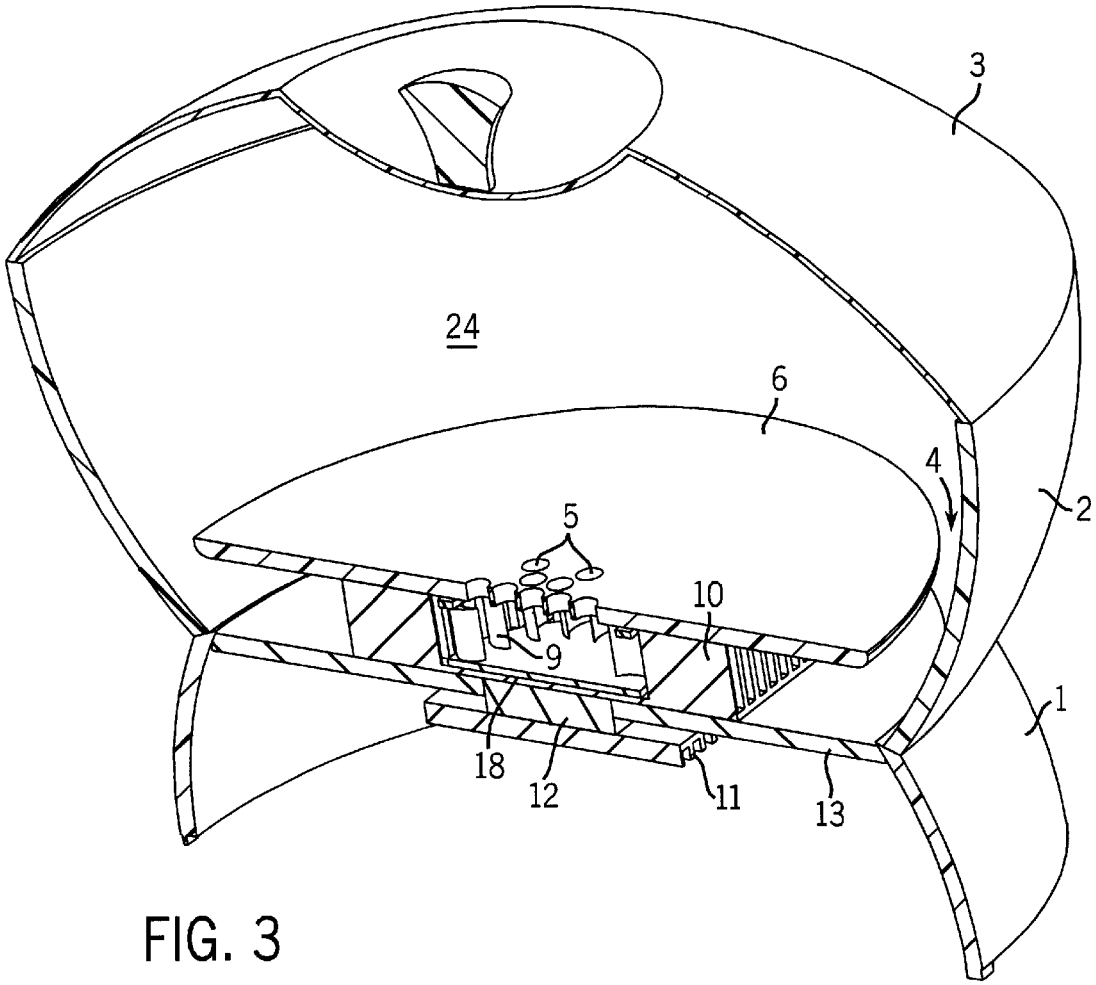
FIG. 3 is a perspective view of the fruit chiller of FIG. 1 cut in half for viewing of the interior components.
Figure 4:
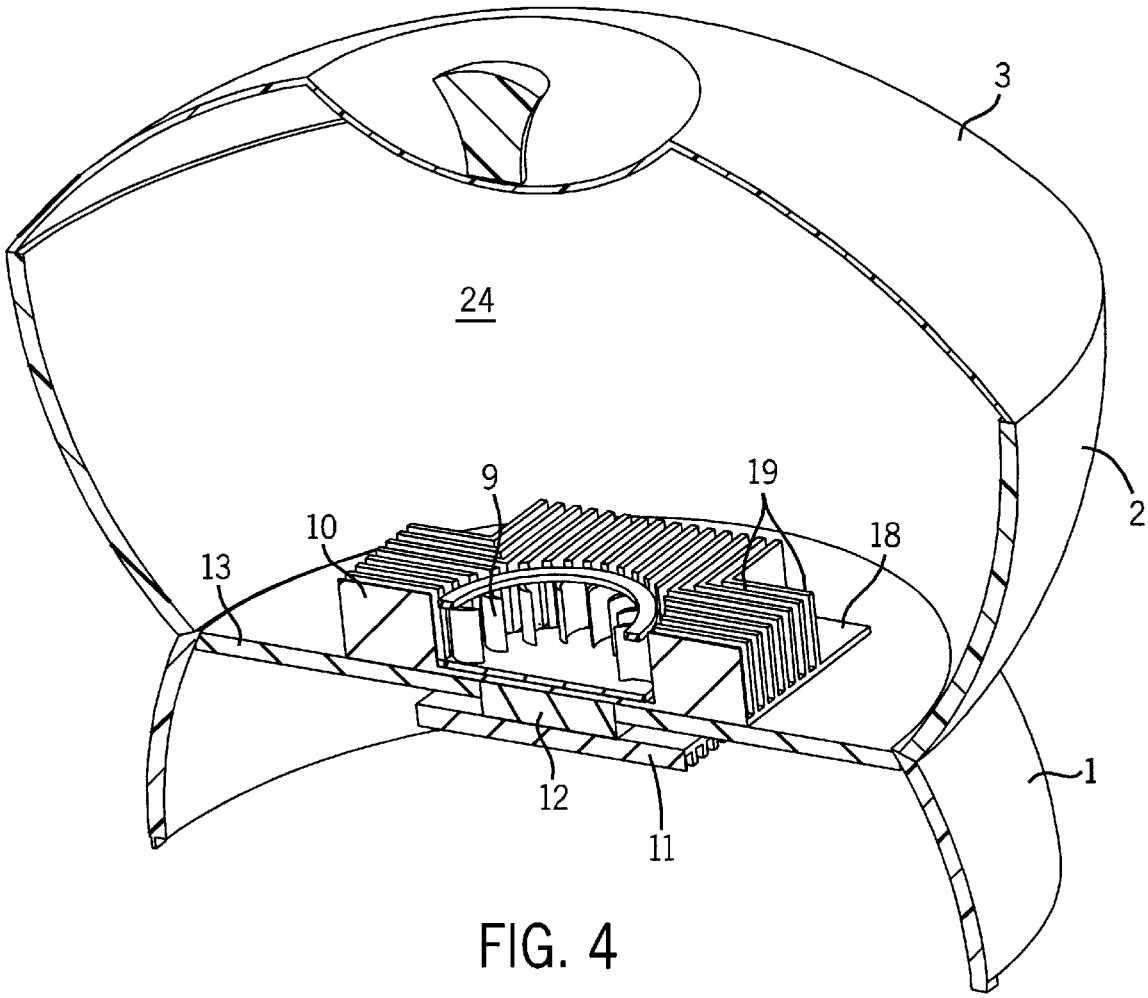
FIG. 4 is a view similar to FIG. 3 with the upper baffle removed.
Figure 5:
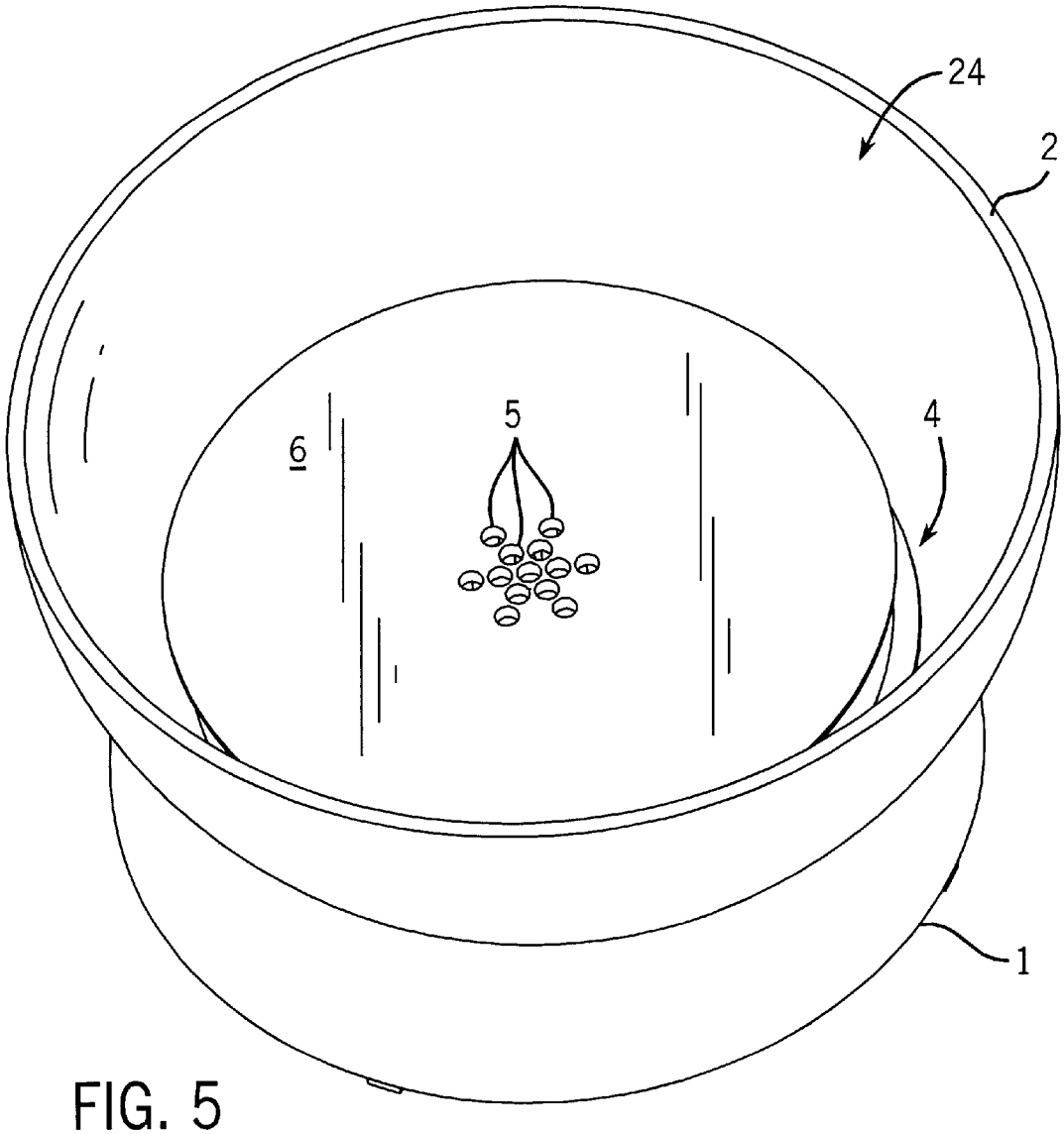
FIG. 5 is a top perspective view of the fruit chiller of FIG. 1 with the cover removed.
Figure 6:
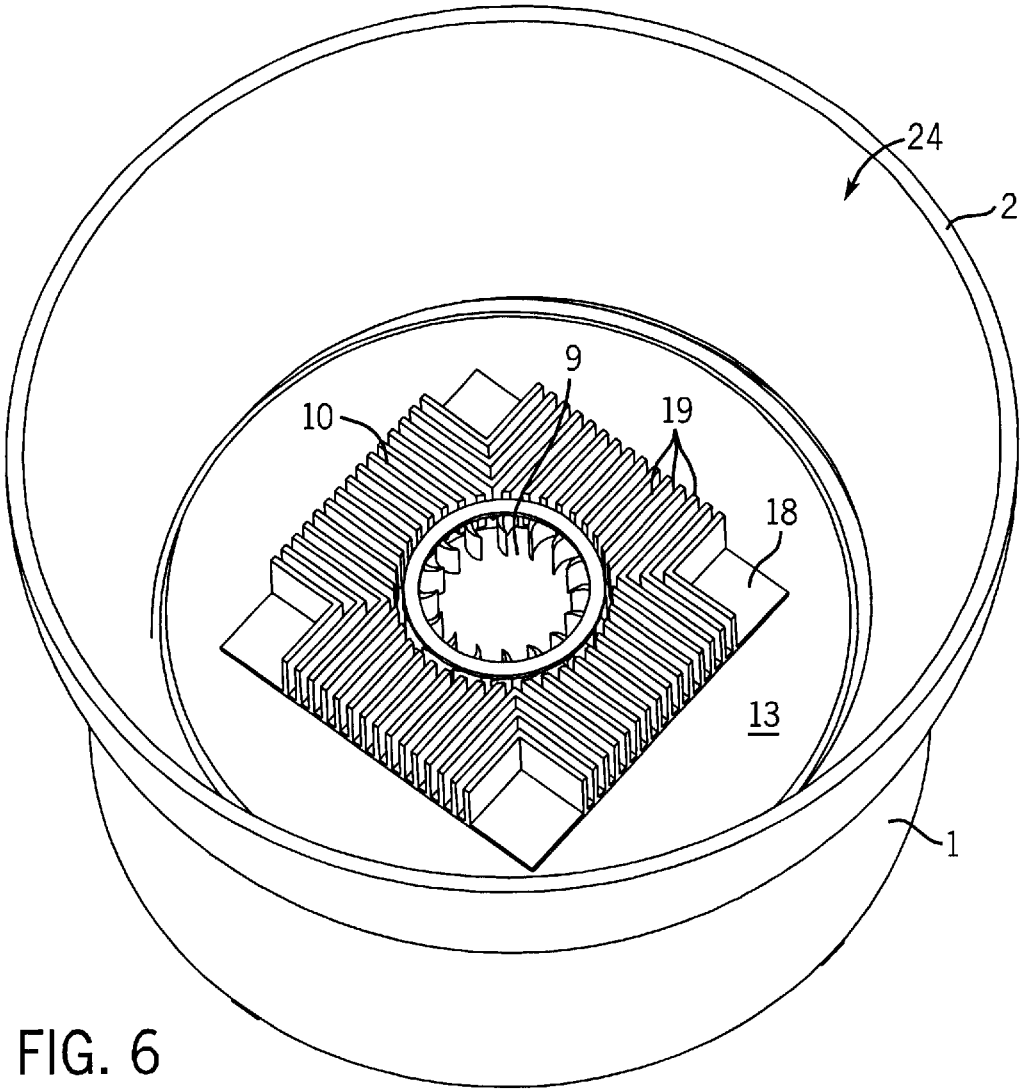
FIG. 6 is a view similar to FIG. 5 with the upper baffle removed.
Figure 7:
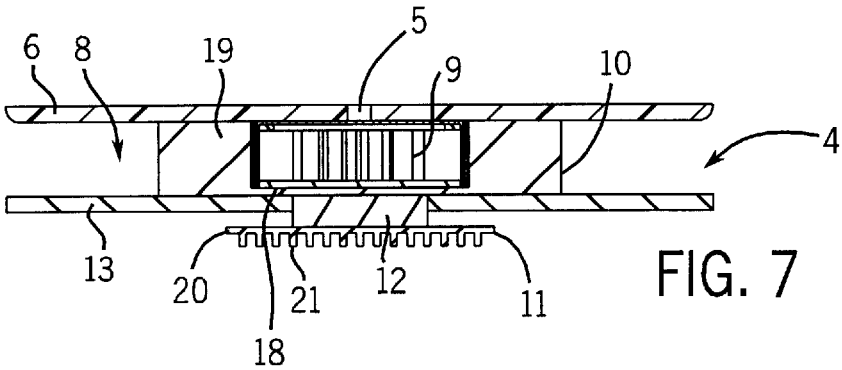
FIG. 7 is a detailed portion of the vertical section view of FIG. 2.
Figure 8:
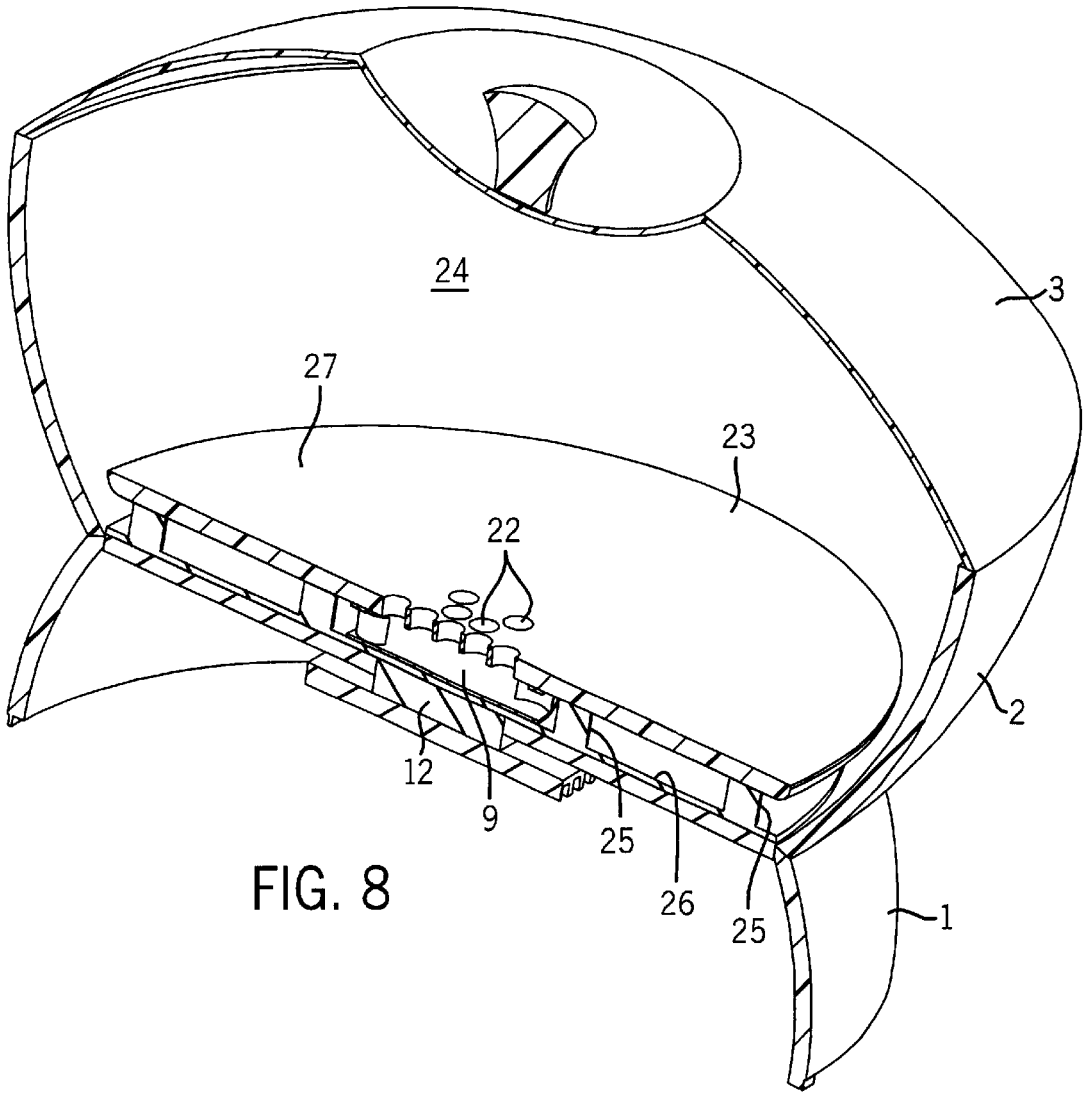
FIG. 8 is a perspective view of an alternate embodiment of the fruit chiller cut vertically in half for viewing of the interior components.
Figure 9:
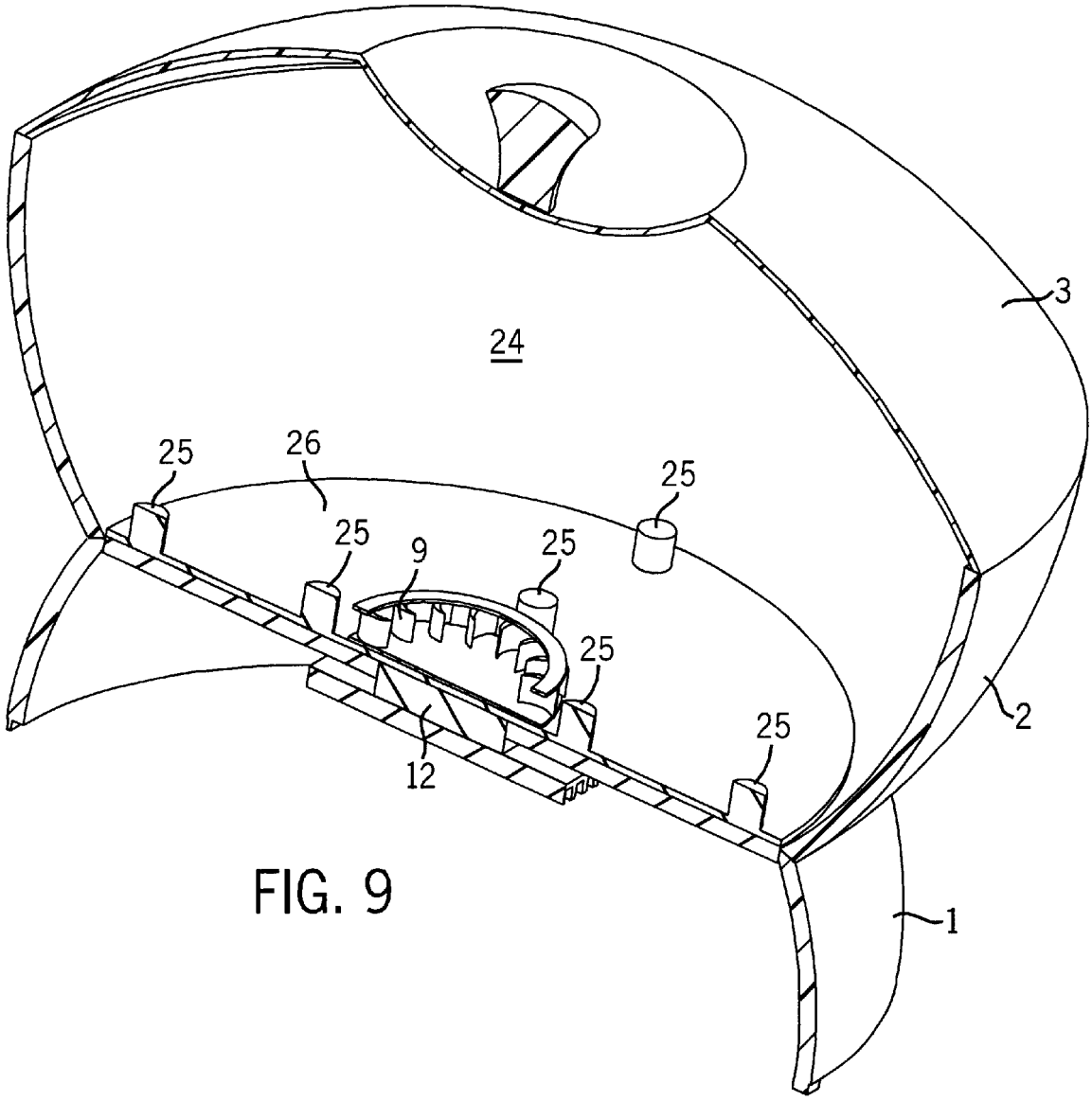
FIG. 9 is a view similar to FIG. 8 with the upper cold sink plate removed.
Figure 10:
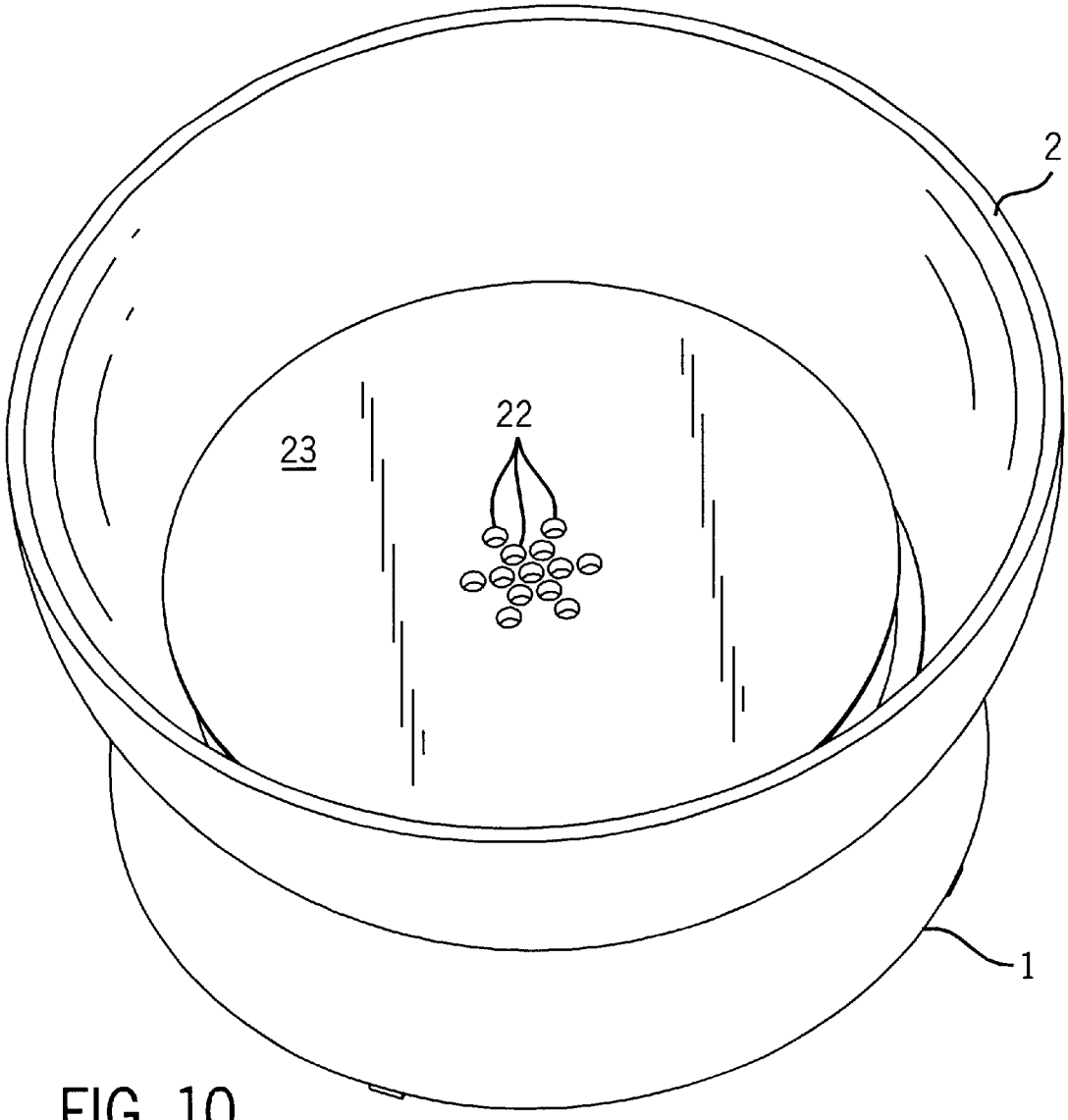
FIG. 10 is a top perspective view of the alternate embodiment of the fruit chiller of FIG. 8 with the cover removed.
Figure 11:
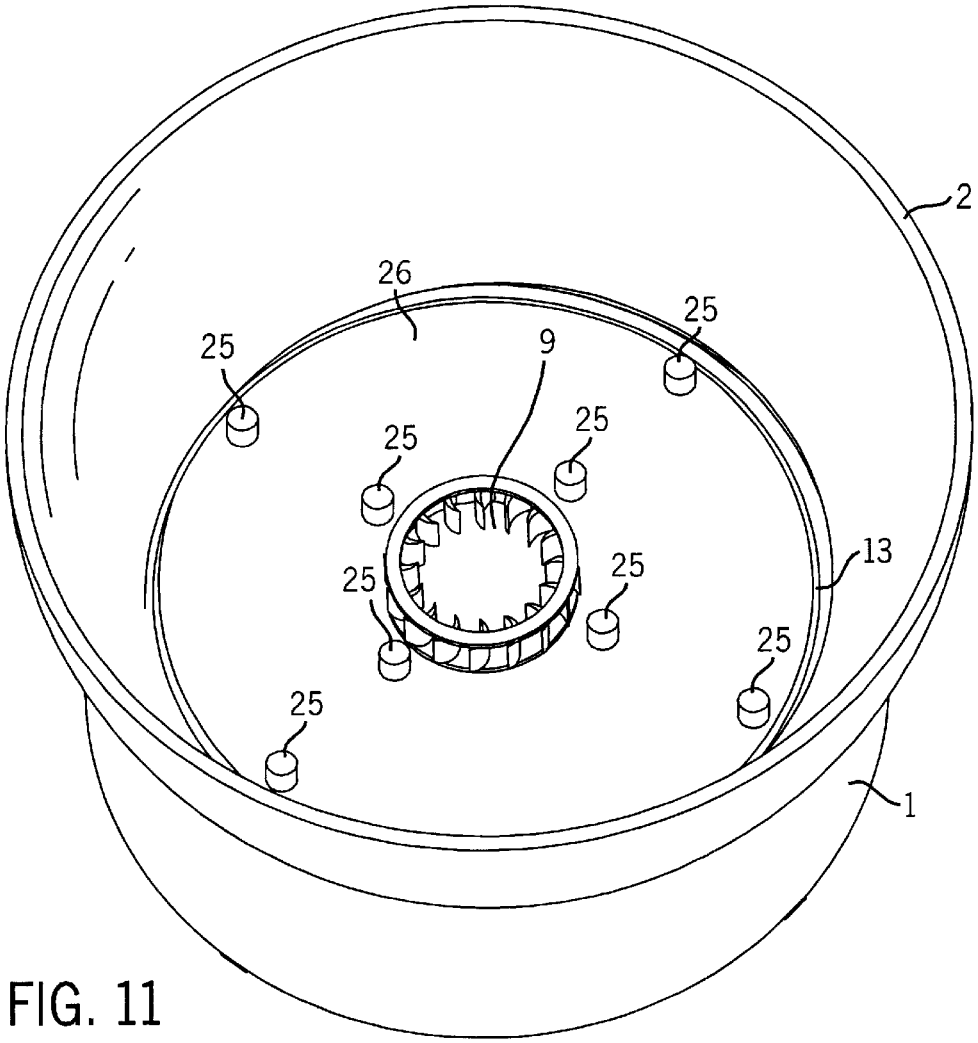
FIG. 11 is a view similar to FIG. 10 with the upper cold sink plate removed.
Figure 12:
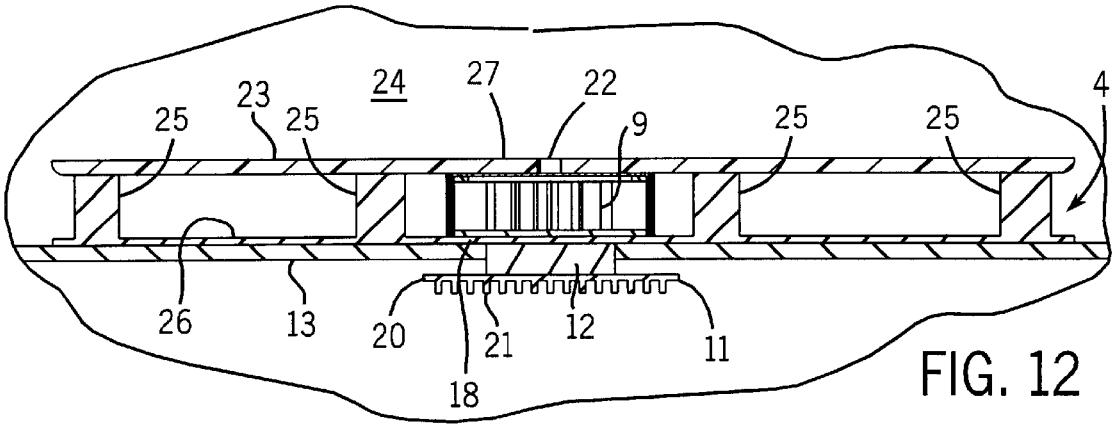
FIG. 12 is a detailed vertical section through the alternate embodiment of the fruit chiller of FIG. 8.

In FIGS. 1 and 2, there is shown a fruit chiller 14 in accordance with one embodiment of the present invention. The fruit chiller includes a supporting base 1 for supporting the chiller on a horizontal surface. There is space inside the base for housing various components of the cooling system, which will be described in detail herein. A container 2 is seated on base 1. A removable cover 3 provides access to the food to be preserved. The base 1, container 2 and removable cover 3 may all be made of injection molded plastic materials. The base 1 is preferably opaque and the container 2 and cover 3 transparent.

Referring also to FIGS. 3–7, the base 1 is suitably supported on legs 15 to provide an open space beneath the base for the entry of ambient cooling air. The lower interior of base 1 defines a substantially open ambient air chamber 16 defined generally by base side walls 17 and a base baffle plate 13.

The container 2 and the food products contained therein are cooled with thermoelectric module 12 utilizing the well-known Peltier effect. The thermoelectric module 12 is mounted in the base baffle plate 13 and positioned generally horizontally in the plane of baffle plate 13. By applying a DC current to the module, heat will be absorbed at one face (in this case the upper side of 12), thereby cooling it. Heat will be dissipated at the other face of the module (in this case the lower side of 12), thereby heating it. As is also well known in the prior art, a cold sink 10 is attached to the upper face of the module 12 and a heat sink 11 is attached to the lower face of the module. The cold sink 10 is typically made of aluminum and includes a flat base 18 and a series of closely spaced fins 19. The cold sink is best viewed in FIG. 6. Similarly, the heat sink 11 includes an aluminum base plate 20 and integral closely spaced fins 21. The heat rejected by the operating thermoelectric module 12 at the heat sink 11 is dissipated by a flow of ambient air through the ambient air chamber 16.

A centrifugal fan 9 draws air in through holes 5 in an upper baffle 6 overlying the cold sink 10, and discharges the air radially past the cold sink fins 19 into (optional) space 8 between the base plate 18 of the cold sink and the upper baffle 6. The air enters the food container interior 24 as it passes between upper baffle 6 and cold sink base 18 and through an annular opening 4. In this manner the air within container interior 24 is recirculated and cooled.

The embodiment described above minimizes manufacturing cost by reducing the number of components to be manufactured.

In another embodiment shown in FIGS. 8 through 12 the cold sink 27 is made of up of a base plate 26 preferably made of aluminum and an upper plate 23 also preferably made of aluminum. Bosses 25 separate base plate 26 and upper plate 23. Air enters the centrifugal fan 9 through holes 22 in upper cold sink plate 23 and exits fan 9 in a radial manner between the cold sink plates 26 and 23. Air enters the food container 24 via opening 4 after it is chilled by coming contact with cold plates 26 and 23. This embodiment reduces manufacturing cost by reducing the number of components to be manufactured. This embodiment also provides a low-profile cooling system thus maximizing the interior room for food storage.

Figure 13:
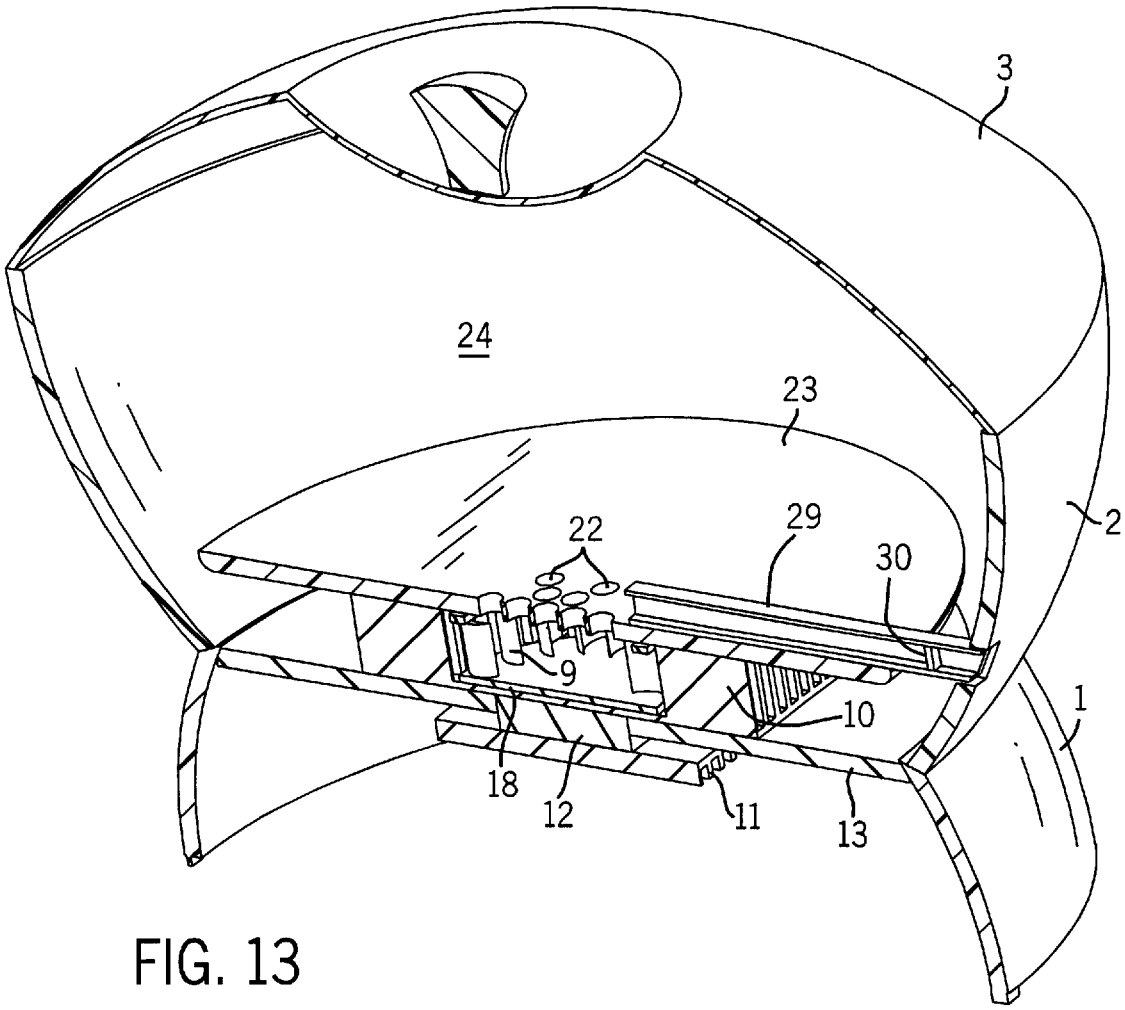
FIG. 13 is a perspective view of an alternate embodiment of the fruit chiller cut vertically in half for viewing of the interior components.
Figure 14:
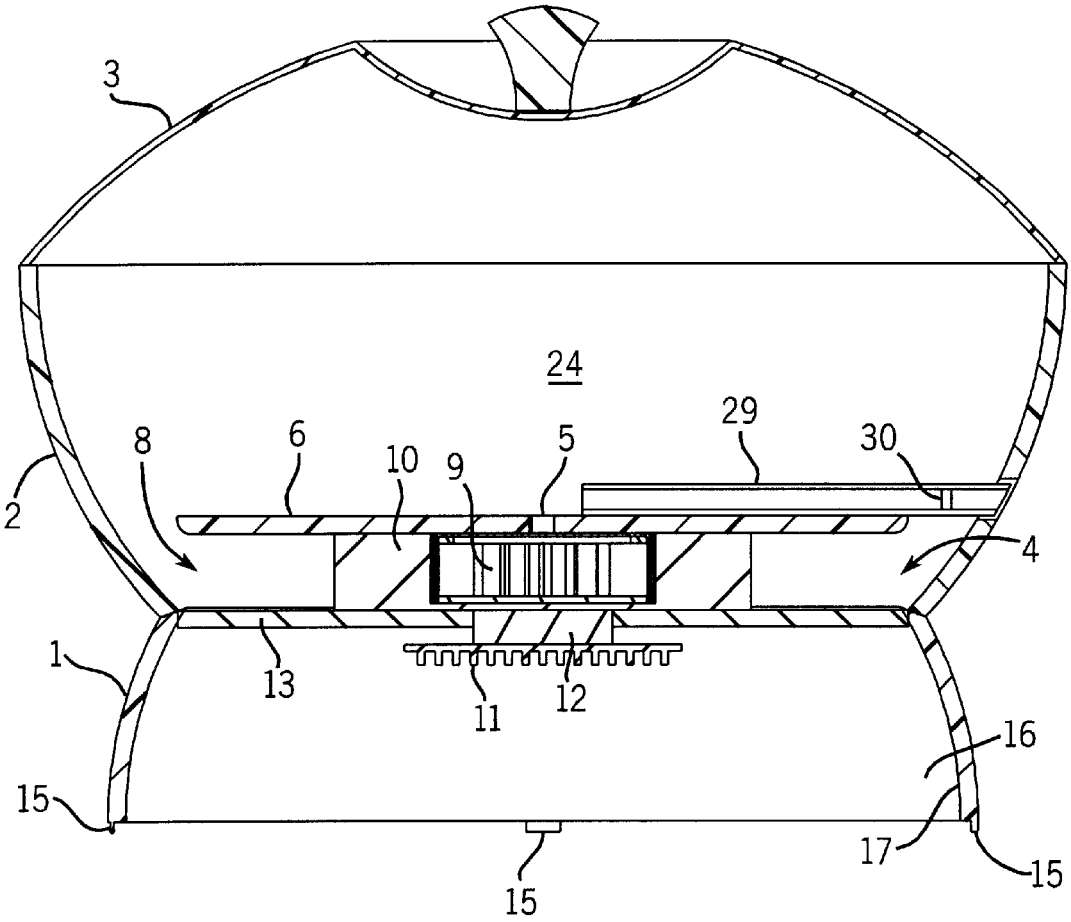
FIG. 14 is a vertical section through the alternate embodiment of the fruit chiller of FIG. 13.

Ripening fruit is known to emit ethylene gas and other by-products of organic decomposition. It may be desirable to exhaust these gasses by regular or periodic replacement of the cooling air recirculating within the container interior 24. Referring particularly to FIGS. 13 and 14, an ambient air conduit 29 comprising a small diameter metering tube extends from the side wall of the food container 2 to the holes 5 where a small volume flow of ambient outside air is drawn in by the cold sink fan 9 and mixed with the recirculated cooling air. As shown, the ambient air conduit 29 opens above the holes 5 just upstream of the inlet to the fan 9. It is believed, however, that the conduit could connect to the duct system at another location therein. The inflow of ambient air may be regulated with the use of an optional pinch valve or a metering valve 30 at the inlet end of the conduit 29. To provide for the corresponding exhaust of ethylene and other gaseous by-products, it is preferred to provide a small leak between the container 2 and the cover 3, however, a manually adjustable vent slot may also be used. Such a slot could be located in either the wall of the container 2 or in the cover 3.

As indicated previously, the thermoelectric module 12 is normally configured so the upper face is cold while the lower face is hot. Because reversal of the polarity of the supplied current to the thermoelectric module causes the direction of heat flow to be reversed, the fruit chillers of either of the embodiments described herein may also be utilized to warm the fruit to promote or enhance ripening. In this alternate configuration the upper face of the thermoelectric module 12 is hot while the lower face is cold.

Certain fruits may often be purchased in a green or semi-ripe condition. One example is bananas which are often purchased in some semi-ripe condition and allowed to ripen in the open air. By reversal of the supplied current to the thermoelectric module 12, a green or semi-ripe fruit may be ripened more quickly by warming and, when ripe, preserved for a longer time by again reversing the current to provide a cooling air supply to the container 24.

In general, temperature control is an excellent, and by far the best means, of controlling ripening in fruit. As discussed above, warming may be used to enhance and promote ripening of green or semi-ripe fruit, but after the fruit has ripened, cooling is the best means available to slow the biological ripening processes and preserve the fruit for a longer period of time.

The direction of heat transfer of the thermoelectric module 12 can be reversed as mentioned above. The level of heating and cooling can also be controlled by control of the level of supplied current and voltage. In this manner, the user may, for example, select a set point to ripen fruits at a desirable rate or, conversely, a cooling set point to maintain ripened fruit at a temperature found to make the fruit most palatable. Other cooling or warming strategies may also be utilized, either with manual settings by the user or by using programmed microprocessor control.

We claim:

1. A food chiller comprising:

a supporting base including a housing;

a Peltier effect thermoelectric device disposed in the housing between a cold sink and a hot sink;

an enclosed food container positioned adjacent the housing and separated therefrom by a base baffle plate;

said container having an outer wall extending from the base baffle plate;

said base baffle plate supporting the thermoelectric device and separating the cold sink and the hot sink;

a separate baffle overlying at least a portion of the cold sink and spaced from said base baffle plate, said baffle having a generally planar food-supporting upper surface and a peripheral outer edge spaced from the container outer wall to define a generally annular air flow opening directly from the cold sink to the interior of the container, and said baffle having a central air flow opening from the container interior to the cold sink; and, a fan disposed adjacent said baffle directly beneath said central opening and in fluid communication with the cold sink to generate a circulating air flow over said cold sink and directly into the container through said annular opening.

2. The apparatus as set forth in claim 1 wherein said cold sink comprises a generally flat base with integral spaced fins extending generally perpendicular to the base.

3. The apparatus as set forth in claim 2 wherein said cold sink is made of aluminum.

4. The apparatus as set forth in claim 2 wherein said base baffle plate supports the cold sink flat base and said baffle comprises an integral portion of said cold sink.

5. The apparatus as set forth in claim 4 wherein said cold sink is made of aluminum.

6. The apparatus as set forth in claim 1 comprising a conduit connecting the container interior to ambient outside air.

7. The apparatus as set forth in claim 6 including a valve in said conduit to control the flow of ambient outside air.

8. The apparatus as set forth in claim 1 comprising an exhaust vent from the interior of the container.

9. The apparatus as set forth in claim 8 wherein said vent comprises an adjustable slot in the container or the cover.

10. The apparatus as set forth in claim 1 including control means for said thermoelectric device for controlling the air flow temperature.

11. The apparatus as set forth in claim 10 wherein said control means comprises means for reversing the polarity of the current supplied to the thermoelectric device.

12. The apparatus as set forth in claim 10 wherein said control means comprises means for controlling the magnitude of current and voltage supplied to the thermoelectric device.

* * * * *